US007484478B2

(12) United States Patent
Garg

(10) Patent No.: US 7,484,478 B2
(45) Date of Patent: Feb. 3, 2009

(54) FIRED HEATER

(76) Inventor: Ashutosh Garg, 5303 April Run Ct., Sugar Land, TX (US) 77479

( * ) Notice: Subject to any disclaimer, the term of this patent is extended or adjusted under 35 U.S.C. 154(b) by 100 days.

(21) Appl. No.: 11/591,100

(22) Filed: Nov. 1, 2006

(65) Prior Publication Data

US 2008/0098967 A1 May 1, 2008

(51) Int. Cl.
*F22B 9/06* (2006.01)

(52) U.S. Cl. ..... 122/44.1; 122/75; 122/121; 122/235.13

(58) Field of Classification Search ..... 122/235.11, 122/235.13, 42, 44.1, 75, 77, 114, 121, 1 A, 122/332, 333
See application file for complete search history.

(56) References Cited

U.S. PATENT DOCUMENTS

| | | | | | |
|---|---|---|---|---|---|
| 1,791,955 | A * | 2/1931 | Cannon | 122/235.12 |
| 2,603,195 | A * | 7/1952 | Permann | 122/333 |
| 2,993,479 | A * | 7/1961 | Thurley | 122/23 |
| 3,854,455 | A * | 12/1974 | Carson et al. | 122/356 |
| 3,938,475 | A * | 2/1976 | O'Sullivan et al. | 122/333 |
| 4,412,975 | A * | 11/1983 | Parizot et al. | 422/197 |
| 4,986,222 | A | 1/1991 | Pickell et al. | |
| 5,656,150 | A * | 8/1997 | Reed et al. | 208/48 R |
| 5,878,699 | A * | 3/1999 | Barnett et al. | 122/1 A |
| 6,237,545 | B1 * | 5/2001 | Barnett et al. | 122/235.23 |
| 6,241,855 | B1 * | 6/2001 | Gibson et al. | 202/124 |
| 6,823,821 | B2 * | 11/2004 | Kayahara et al. | 122/367.1 |
| 2006/0275724 | A1 * | 12/2006 | Joshi et al. | 431/181 |

OTHER PUBLICATIONS

Garg, Ashutosh "Optimized Fired Heater Operation Saves Money" Hydrocarbon Processing, Jun. 1997.
Garg, Ashutosh "Revamp Fired Heaters to Increase Capacity" Hydrocarbon Processing, Jun. 1998.
Garg, Ashutosh "Trimming Nox from Furnaces" Chemical Engineering, Nov. 1992.

* cited by examiner

*Primary Examiner*—Gregory A Wilson
(74) *Attorney, Agent, or Firm*—John R Casperson

(57) ABSTRACT

Two improvements for heaters are disclosed which can be implemented as either apparatus or method. First is a novel flue gas injection system. Second is a novel burner configuration. The improvements can be used alone or together. In the flue gas injection system, flue gas is injected between the burners and the tubes to reduce heat flux on the tubes and shift part of the heat duty from the radiant to the convective section. These approaches work toward increasing the capacity of heaters where we can increase the firing rate in the heater and still keep the tube metal temperature and radiant fluxes within acceptable limits.

14 Claims, 7 Drawing Sheets

FIRED HEATER

FIELD OF THE INVENTION

In one aspect, this invention relates to fired heaters used in the petrochemical and petroleum refining industries for heating charge stock. In another aspect, this invention relates to methods for operating fired heaters to provide an increased throughput of charge stock and/or a reduced coking rate.

BACKGROUND OF THE INVENTION

Fired heaters are the most important and largest equipment in any refinery. Refineries always want to push their heaters to the limit. In most of the fired heaters used in the refining and petrochemicals industry, hydrocarbons are heated inside the tubes. As these hydrocarbon fluids are heated, some of the hydrocarbons start cracking and getting converted into carbon due to high film temperature. A major limitation in the ability of refineries to push their heaters to the limit is linked to coke formation in the radiant section tubes. With excessive coke formation, the refiners cannot process the required throughput through the furnace and have to shutdown to clean the heaters prematurely.

In the radiant section of the heaters, heat is transferred from the outside of the furnace tubes to the fluid inside by conduction through the metal of the tubes. Heating the oil molecules to high temperature causes 'cracking' with the subsequent formation of coke on the inner surface of the tubes. The coke layer formed is a poor conductor of heat. It insulates the tubes and impedes the heat transfer. The heater must be fired harder to maintain the process fluid at the required outlet temperature.

Firing the heater harder creates inevitable problems. Following initial lay down of coke in a heater tube a vicious circle begins in which more and more coke is laid down. The coking rate increases with the temperature in the tubes. It keeps on depositing in the hotter layers of the existing permeable coke. Eventually the coke hardens and becomes impermeable. The fired heater operation not only becomes inefficient (due to higher heat losses in the flue gases resulting from the increased heat input), but also potentially dangerous. The danger lies in the excessively high temperatures that the tubes may reach, which can cause rapid scaling of the metal and possible rupture of the tube. In addition to actual tube rupture, tubes can sag or bow. A tube will sag under its own weight if the tube becomes grossly overheated. Uneven coke lay down in a tube will also make one side of the tube expand more than the other side, leading to bowing. Tube metals differ according to the type of process and severity of duty but they can all suffer damage due to overheating. Further, as the heater is fired harder, the risk of flame impingement on the tubes also increases. As coke can also be laid down by flame impingement, sometimes localized 'hot spots' can develop on tubes where flame impingement has occurred.

Coke formation is thus an inevitable outcome of most fired heater operations. Ultimately the heater needs to be shut down and the coke removed from the tubes. These shutdowns cost refineries a lot of down time and money. A heater which operates in such a way as to slow the rate of coke buildup would be very desirable.

A heater which operates to slow the rate of coke buildup will be most beneficial to the fired heaters in the refinery which are prone to heavy coking. Examples of heaters where there is high need for reduced coking are crude heaters, vacuum heaters, and coker heaters etc.

In the crude heater, crude oil is preheated from 450° F. to 650° F. before it is sent to the atmospheric distillation tower for refining.

In the vacuum heater, bottoms from the atmospheric distillation tower are heated under vacuum to 750-800° F. and then sent to vacuum distillation tower for refining.

In the coker heater, vacuum tower bottoms and residues from other units are sent to the coker heater where they are heated to 900-935° F. Coker heater outlet goes to coke drum and fractionating tower where the products are recovered. Coker heaters have typical run length of only 6 months-1 year.

OBJECTS OF THE INVENTION

It is an object of this invention to provide heaters which minimize coke build up in tubes.

It is another object of this invention to provide methods of operating heaters in a manner which resists coke build up.

It is a further object of this invention to provide heaters with an increased throughput.

SUMMARY OF THE INVENTION

I have developed a new approach towards increasing the capacity of heaters where we can increase the firing rate in the heater and still keep the coking rates, the tube metal temperature and radiant fluxes within acceptable limits.

I have invented two improvements for heaters which can be implemented as either apparatus or method. The first is a novel cool gas injection system to protect the tubes from excessive heat flux. It is preferably implemented with a novel allocation of heat duty between the radiant tubes and the convective tubes. The second is a novel burner configuration to protect the tubes from flame impingement. The improvements can be used alone or together.

One embodiment of my invention provides a method of operating a fired heater to heat a hydrocarbon feedstock flowing though a tubing positioned along a periphery of the heater. The heater includes one or more burners positioned at a spaced apart location inwardly from the tubing. The method is carried out by introducing a plurality of relatively cool gas streams between the burners and the tubing to moderate burner heat flux on the tubing. The preferred relatively cool gas streams comprise flue gas from the unit.

The method can be carried out in an apparatus comprising a floor, a wall means extending upwardly from the floor, at least one burner, a stack, a radiant set of tubes, a manifold, a conduit means, and supplies of charge stock, fuel, and combustion supporting gas. The wall means extends upwardly from the floor and defines a peripherally enclosed radiant heating furnace section. At least one burner opens into the radiant heating furnace section through the floor and produces a flame and flue gases. The stack is positioned in flow communication with the radiant heating furnace section to carry away the flue gases produced by the at least one burner. The set of radiant tubes is positioned adjacent to the wall means for receiving the hydrocarbon containing charge stock and heating the charge stock primarily by radiant heating. The supply of a hydrocarbon-containing charge stock is connected in flow communication with the set of radiant tubes. The supply of combustible fuel and supply of combustion-supporting gas are connected in flow communication with the at least one burner. The manifold means defines a plurality of upwardly oriented openings peripherally spaced around the at least one burner at a location closely adjacent the set of radiant tubes for the introduction of gas along an inwardly facing surface of the set of radiant tubes. The conduit means connects the stack and the manifold means to carry flue gas from the stack to the manifold means to form a curtain of flue gas between each flame and the set of radiant tubes.

Another embodiment of my invention provides a method of operating a fired heater. The method is applicable to a fired heater comprising a radiant heating section comprising a set of radiant tubes positioned closely adjacent to a sidewall which defines an outer limit of the radiant heating section and a burner positioned in the bottom of the radiant heating section at a spaced apart location from the sidewall. The method comprises emitting a flame from the burner in a direction which angles away from the set of radiant tubes.

The method can be carried out in an apparatus comprising a floor, a wall means, a stack, a set of radiant tubes, a plurality of burners, and supplies of charge stock, fuel, and combustion supporting gas. The wall means extends upwardly from the floor and defines a peripherally enclosed radiant heating furnace section. The stack is positioned in flow communication with the radiant heating furnace section to carry away flue gases produced in the furnace section. The set of radiant tubes is positioned adjacent to the wall means and is for receiving the hydrocarbon containing charge stock from a suitable source and for heating the hydrocarbon-containing charge stock primarily by radiant heating. The plurality of burners open into the peripherally enclosed radiant heating furnace section from the floor at spaced apart locations from the set of radiant tubes. Each of the plurality of burners is connected to a supply of combustible fuel and a supply of combustion-supporting gas and is operable to produce a flame extending upwardly through the radiant section generally toward the stack, and flue gases. Each of the plurality of burners is angled away from a most closely adjacent radiant tube of the set of radiant tubes so that the produced flame angles away from the most closely adjacent radiant tube of the set.

DETAILED DESCRIPTION OF THE INVENTION

Figure 1:
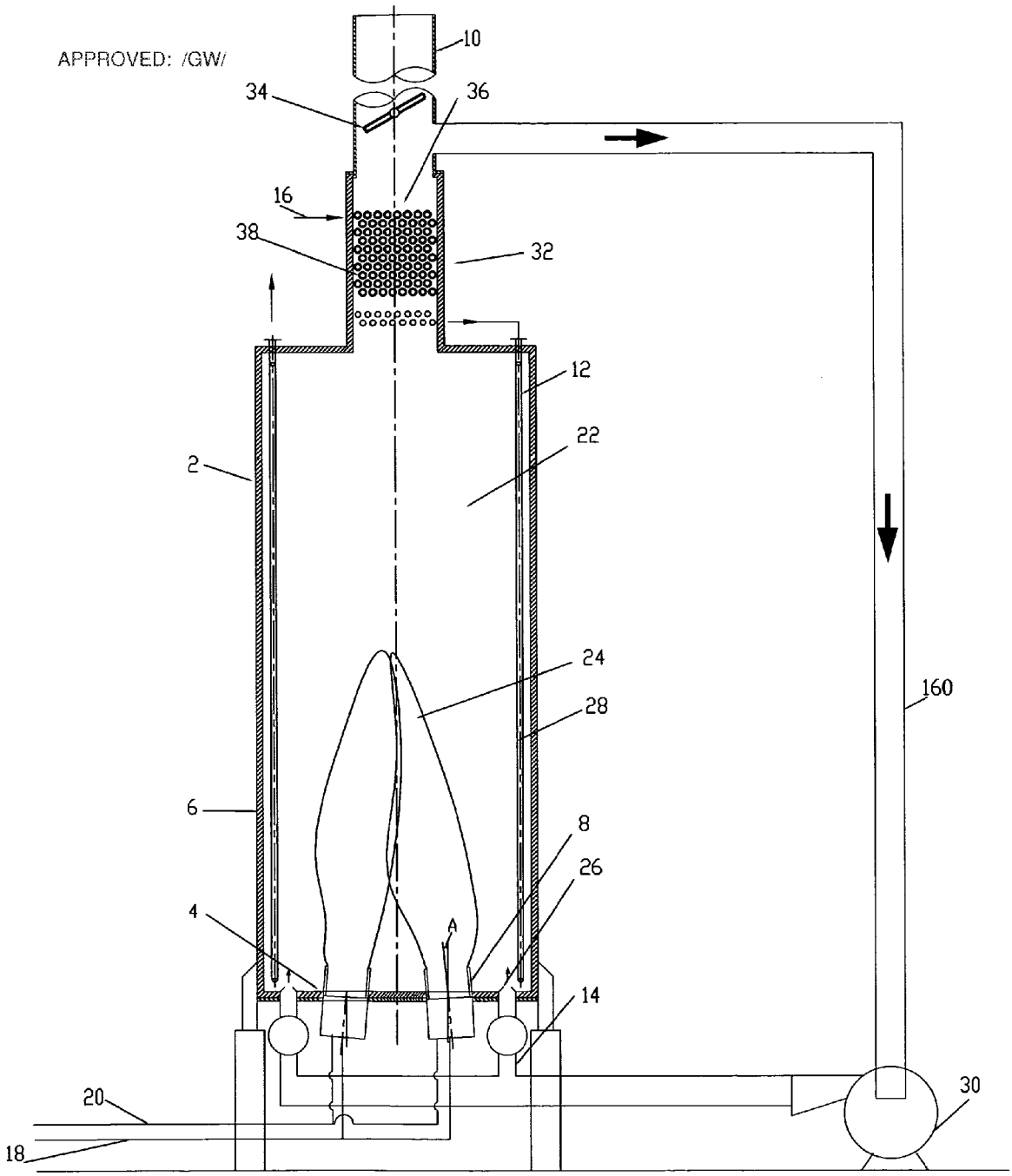
FIG. 1 is a cross-section view of a heater, partly in schematic, illustrating certain features of my invention.

In one embodiment of my invention, there is provided a method of operating a fired heater to heat a hydrocarbon feedstock flowing though a tubing positioned along a periphery of the heater. The heater includes one or more burners positioned at a spaced apart location inwardly from the tubing. The method is carried out by introducing a plurality of relatively cool gas streams between the burners and the tubing to moderate burner heat flux on the tubing. The method is expected to provide good benefits when heating heavy oils, for example, petroleum oils or petroleum residuum, to high outlet temperatures, for example, in the range of 750 to 950 F.

In the preferred embodiment, the burners produce flue gases. These flue gases are cooled and the relatively cool gas streams are formed from a portion of the cooled flue gases. In the range of 15% to 60% of the flue gases produced by the at least one burner can be used in this manner. The streams are preferably introduced into the fired heater to form a curtain of relatively cool gases adjacent a side of the tubing facing the burners.

The method can be carried out in an apparatus 2 comprising a floor 4, a wall means 6 extending upwardly from the floor, at least one burner 8, a stack 10, a radiant set of tubes 12, a manifold 14, a conduit means 160 and supplies of charge stock 16, fuel 18, and combustion supporting gas 20. The wall means extends upwardly from the floor and defines a peripherally enclosed radiant heating furnace section 22. At least one burner opens into the radiant heating furnace section through the floor and produces a flame 24 and flue gases. The stack is positioned in flow communication with the radiant heating furnace section to carry away the flue gases produced by the at least one burner. The set of radiant tubes is positioned adjacent to the wall means for receiving the hydrocarbon containing charge stock and heating the charge stock primarily by radiant heating. The supply of a hydrocarbon-containing charge stock is connected in flow communication with the set of radiant tubes. The supply of combustible fuel and supply of combustion-supporting gas are connected in flow communication with the at least one burner. The manifold means defines a plurality of upwardly oriented openings 26 peripherally spaced around the at least one burner at a location closely adjacent the set of radiant tubes for the introduction of gas along an inwardly facing surface 28 of the set of radiant tubes. The conduit means connects the stack and the manifold means to carry flue gas from the stack to the manifold means to form a curtain of flue gas between each flame and the set of radiant tubes.

Figure 2:
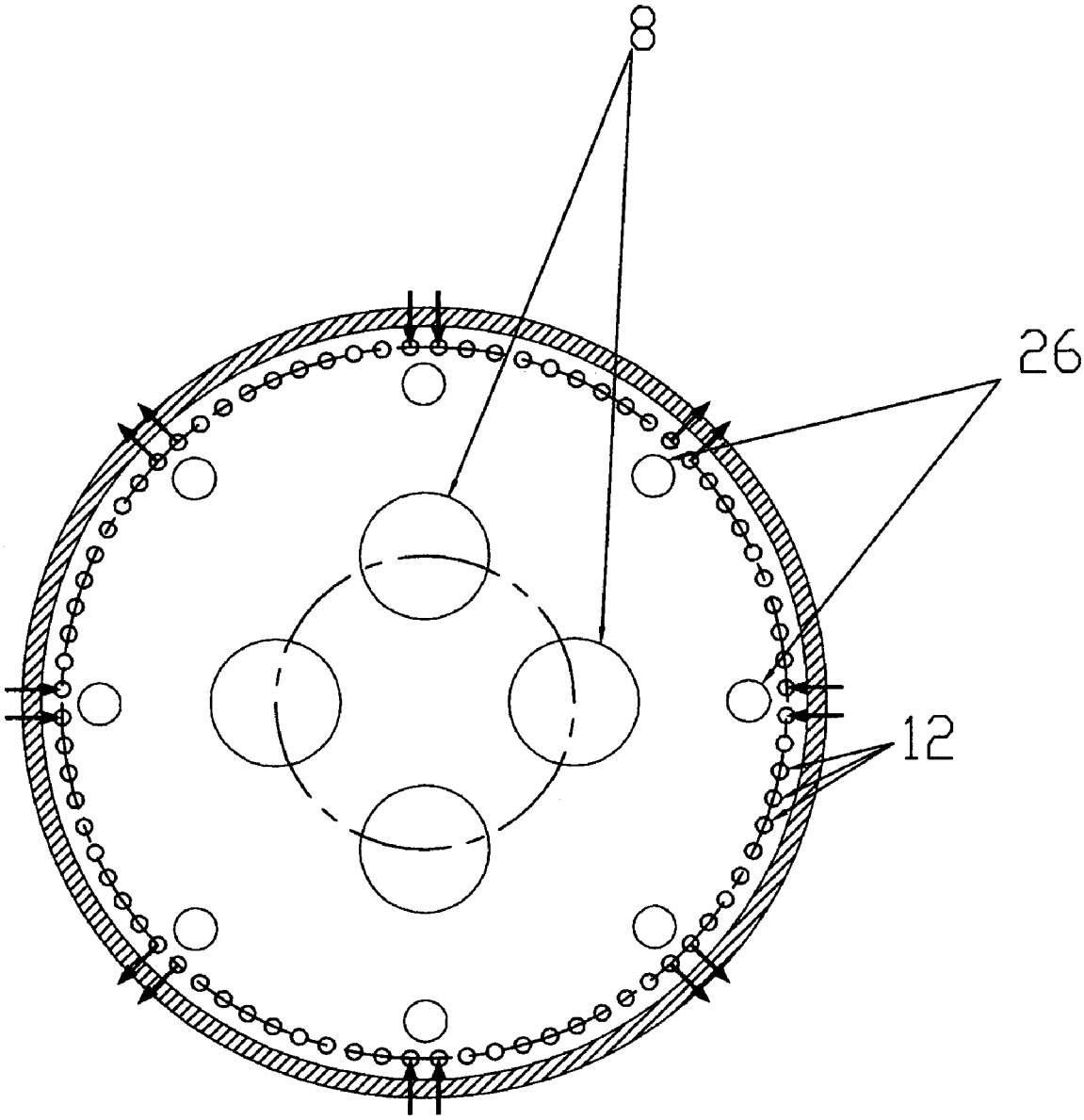
FIG. 2 is a plan view of a heater floor, illustrating certain features of my invention.

The flue gas injection nozzles preferably have a special design to enable spreading of flue gas and maximizing the coverage of tubes. Some of the designs are shown. See FIG. 2. The number of flue gas injection nozzles employed will be dependent upon the amount of flue gas injection and the geometry of the heater.

Preferably, the conduit means further comprises a blower 30 to draw flue gases from the stack and inject flue gases into the radiant heating furnace section through the manifold means. The flue gases are preferably withdrawn from between a convective section 32 and a damper 34 positioned in the stack.

For efficiency, it is preferable to utilize a convection section on the heater. The wall means preferably further defines a peripherally enclosed convection heating furnace upper section 36 in flow communication with the radiant heating race section. The convection section receives flue gases from the radiant heating furnace section and exhausts the flue gases to the stack. A set of convection tubes 38 is positioned across the upper convection section for receiving a hydrocarbon-containing charge stock and heating the hydrocarbon-containing charge stock though primarily convection heating. The set of radiant tubes receives preheated hydrocarbon containing charge stock from the set of convection tubes.

For enhanced efficiency, it is also preferable to size the relative heat duties in the convection section and the radiant section. The set of convection tubes has a first heat duty as measured in MMBtu/hr and the set of radiant tubes has a second heat duty as measured in MMBtu/hr. The ratio between the first heat duty and the second heat duty is generally around 30/70, and it could be in the range from 20/80 to 50/50 depending upon the type and design of fired heater.

Generally speaking, when flue gas injection in accordance with the invention is utilized, in the range of 5% to 15% of the heat duty is shifted from the radiant section to the convective section.

In the illustrated embodiment, the peripherally enclosed radiant heating furnace section is generally cylindrically shaped and vertically oriented and the manifold means comprises a hollow plenum ring having discharge openings in flow communication with the plurality of upwardly oriented openings. The manifold means defines in the range of from 6 to 36 upwardly oriented openings laid out to produce a cylindrically shaped curtain of flue gases along an inwardly facing surface of the set of radiant tubes. The upwardly oriented openings are preferably defined by nozzles to assist in creating a curtain of relatively cool gases.

The manifold means and the conduit means are preferably sized to inject in the range of 15% to 60% of the flue gases into the radiant heating furnace section, depending on process needs.

A preferred embodiment of the invention is a method for increasing capacity and reducing coking in fired heaters using flue gas injection technique as described above. Part of the flue gas leaving stack is withdrawn and sent to a flue gas fan. Flue gas injection is carried out in the radiant section of the fired heaters. It reduces the fire box temperatures and cools the flame and flue gases. This in turn reduces the coking rates and heat absorption in the radiant section.

Typical prior art heaters are of two major types, Vertical Cylindrical and Cabin. The drawing illustrates only the Vertical Cylindrical heater, but the invention can also be applied to Cabin Heaters as well. In the Vertical Cylindrical heater, the radiant tubes are laid out in a circle in a horizontal manner. The flow of fluid is generally from top to bottom. The burners are provided on the floor and are spaced for providing near uniform heat distribution.

The convection section is mounted on top of the radiant section. It consists of bare and extended surface tubes. Finned tubes are used in gas-fired heaters and studded tubes are used in oil-fired heaters. The convection section in prior art heaters without flue gas injection typically absorbs 20-40% of the total heat duty while the radiant section absorbs the rest. The stack is mounted on top of the convection section to provide draft and dispose the flue gas safely.

With flue gas injection, the firing rate can be increased. Flue gas injection is carried out by means of withdrawing cold flue gases leaving the stack of the heater and injecting these flue gases in the radiant section floor through specially designed nozzles. These flue gases not only cool the firebox but also create turbulence in the firebox which eliminates dead zones in the firebox and creates uniform flue gas temperatures throughout the firebox. The flue gas injection creates a layer of cold flue gases around the tubes and protects them from direct flame impingement and coking.

This method is very suitable for heaters which are already operating at the maximum capacity and it is not possible to increase capacity using conventional means. A number of refiners are revamping their heaters to process more charge rate. Typical revamps carried out are carried out to provide 20% to 40% extra capacity for the heater and other equipment. One of the most common ways of increasing the heater capacity is to keep on increasing the firing until zone hits the radiant flux or tube metal temperature limit. The drawbacks of this approach have been discussed hereinabove. Other way to increase capacity of the heater is by addition of heat transfer surface in the convection section. In this method, the capacity increase is limited to reducing the flue gas temperature about 100-200 F above the charge inlet temperature.

When this embodiment of the invention is used, the flue gas injection will cool the radiant flames and induce turbulence in the firebox. Coking rates are directly proportional to the film temperature. Film temperature is directly related to heat transfer rate. Heat transfer rate is proportional to the flue gas temperature. Thus, by lowering the flue gas temperature and increasing turbulence in the firebox, the coking rate in the tubes can be reduced by as much as 50%. This will mean the run length of the heater will be doubled.

Flue gases are generated by the combustion of hydrocarbon fuels. They are let out from the stack after they have given out heat to the fluid being heated in the radiant and convection section. Lower temperatures in the firebox enable firing of more heat into the same firebox without correspondently increasing the heat fluxes and tube metal temperatures. The heat transfer is shifted to the convection section. This is generally achieved by providing additional tubes in the convection section which have a higher surface area or a more efficient heat transfer. Whereas the prior art generally allocated heat duty between the radiant section and the convective section at a ratio of 70:3 0 or higher, in my invention it is generally 60:40 or even lower. In my invention, the convection section heat duty is generally increased by at least 5-15% and the radiant duty is reduced correspondingly.

Flue gas injection shifts the heat duty from radiant to convection section and additional heat transfer surface may be required to absorb the additional heat in the convection section. The preferred embodiment of the invention provides for that.

Another embodiment of my invention is provided in the form of a method of operating a fired heater. The method is applicable to a fired heater comprising a radiant heating section comprising a set of radiant tubes positioned closely adjacent to a sidewall which defines an outer limit of the radiant heating section and a burner positioned in the bottom of the radiant heating section at a spaced apart location from the sidewall. The method comprises emitting a flame from the burner in a direction which angles away from the set of radiant tubes. The angle A preferably is in the range of from about 5 degrees to about 15 degrees.

Where the radiant section is generally cylindrically shaped and has a longitudinal axis, a plurality of burners is generally positioned in the bottom of the radiant heating section spaced apart from the longitudinal axis and inclined to emit flame angling toward the longitudinal axis and away from the most closely adjacent tube set. The method can also be employed in a heater having a generally cabin-shaped radiant furnace heating section by angling the flame away from the most closely adjacent cabin wall.

The method can be carried out in an apparatus comprising a floor 4, a wall means 6, a stack 10, a set of radiant tubes 12, a plurality of burners 8, and supplies of charge stock 16, fuel 18, and combustion supporting gas 20, preferably air. The wall means extends upwardly from the floor and defines a peripherally enclosed radiant heating furnace section 22. The stack is positioned in flow communication with the radiant heating furnace section to carry away flue gases produced in the furnace section. The set of radiant tubes is positioned adjacent to the wall means and is for receiving the hydrocarbon containing charge stock from a suitable source and for heating the hydrocarbon-containing charge stock primarily by radiant heating. The plurality of burners open into the peripherally enclosed radiant heating furnace section from the floor at spaced apart locations from the set of radiant tubes. Each of the plurality of burners is connected to a supply of combustible fuel and a supply of combustion-supporting gas and is operable to produce a flame extending upwardly through the radiant section generally toward the stack, and flue gases. Each of the plurality of burners is angled away from a most closely adjacent radiant tube of the set of radiant tubes so that the produced flame angles away from the most closely adjacent radiant tube of the set The angle A generally is in the range of from 5 degrees to 15 degrees, as measured from vertical.

If desired, each burner can comprise a low NOx burner, which generally emits a longer, relatively poorly defined flame which is more likely to impinge the tubes, and in such case the apparatus may further comprise means for injecting flue gases into each burner.

Preferably, the wall means further defines a peripherally enclosed convection heating furnace upper section 36 in flow communication with the radiant heating furnace section. The convection section receives flue gases from the radiant heating furnace section and exhausts flue gases to the stack. The apparatus preferably further comprises a set of convection tubes 38 positioned across the upper convection section for receiving a hydrocarbon-containing charge stock and heating the hydrocarbon-containing charge stock though primarily convection heating, the set of radiant tubes receiving the hydrocarbon containing charge stock from the set of convection tubes. The set of convection tubes has a first heat duty as measured in MMBtu/hr, and set of radiant tubes has a second heat duty as measured in MMBtu/hr. The ratio between the first heat duty and the second heat duty is preferably at least 35/65.

Prior art fired heaters have burners installed on the floor. These burners are firing vertically upright. The burners can have long flames and they can start impinging upon tubes in the prior art configuration. This can even lead to the tube failure. In the illustrated embodiment of my invention, the burners are installed at an angle with flames directed away from the tubes and towards the center of the heater as shown in the Figure. This angle of mounting can vary from 5 to 15 degrees depending upon the burner size, burner number, type, firebox height, burner circle diameter, etc.

This configuration will ensure that all flames are pulled toward the center of the heater. This will eliminate any chances of flame impingement on the tubes and avoid tube failures and high tube metal temperatures. This invention is especially beneficial for heaters that are currently suffering from flame impingement problems or are contemplating increasing the firing rate in the heaters.

CALCULATED EXAMPLE

We have carried out simulation of a heater with and without flue gas injection to quantify the benefits of flue gas injection.

The heater used in this example is a crude heater. It is vertical cylindrical in construction. The heater was originally designed for 130 MMBtu/hr and had already been revamped to 174 MM Btu/hr. process duty. The client wanted to increase the heat duty further to 210 MM Btu/hr. In this heater the radiant heat flux was already high at 15,000 Btu/hr ft2 and beyond the typical range of 12,000 Btu/hr ft2 for conventional heaters. It is not possible to increase the capacity of this heater by harder firing or using any conventional means. However by using FGI (Flue Gas Injection) we could not only increase the capacity of this heater but we could even lower the radiant heat fluxes and tube metal temperature. The original heat duty split was 68/32 and after the revamp it was changed to 54/46. With FGI, the heat duty split will change to 44/56. and almost 12% duty is transferred to the convection section.

The heater performance is compared in the table provided. The flue gas injection is pegged at 35%. Flue gas temperature leaving radiant section is about 150 F lower with flue gas injection. Radiant flux is reduced from 15,000 to 12,000 Btu/hr ft2. Maximum radiant flux is reduced from 27,000 to 21000. The relative coking rates are shown for tube numbers 1-9 in the radiant section.

TABLE I

Crude Heater Performance with Flue Gas Injection

| | | Without Flue | With Flue gas |
|---|---|---|---|
| Flue Gas Injection Rate | Mlb/hr | 0 | 110 |
| Heat Duty | MMBtu/hr | 210.8 | 209.7 |
| Fired Heat | MMBtu/hr | 233.3 | 231.9 |
| Radiant Heat Duty | | 114.5 | 92.5 |
| Convection Heat Duty | | 96.3 | 117.2 |
| Radiant Heat Duty Split | % | 54.3 | 44.1 |
| FGT leaving Radiant Section[1] | degrees F. | 1848.6 | 1697.4 |
| FGT leaving Convection | degrees F. | 583.5 | 612.4 |
| Avg Radiant Heat Flux[2] | Btu/hr/ft2 | 14,898 | 12,028 |
| Max Radiant Heat Flux[3] | Btu/hr/ft2 | 27,127 | 21,860 |
| Max Shield Heat Flux | Btu/hr/ft2 | 23,888 | 19,639 |
| Max Film Temp. in Radiant | degrees F. | 766.4 | 754.6 |
| Max Tube Metal temp, Radiant[4] | degrees F. | 927.6 | 884.7 |
| Relative Coking Rate in Radiant[5] | 1 | 0.168 | 0.199 |
| | 2 | 0.185 | 0.212 |
| | 3 | 0.237 | 0.258 |
| | 4 | 0.257 | 0.269 |
| | 5 | 0.318 | 0.319 |
| | 6 | 0.644 | 0.549 |
| | 7 | 0.761 | 0.627 |
| | 8 | 0.796 | 0.635 |
| | 9 | 0.881 | 0.681 |

Figure 3:
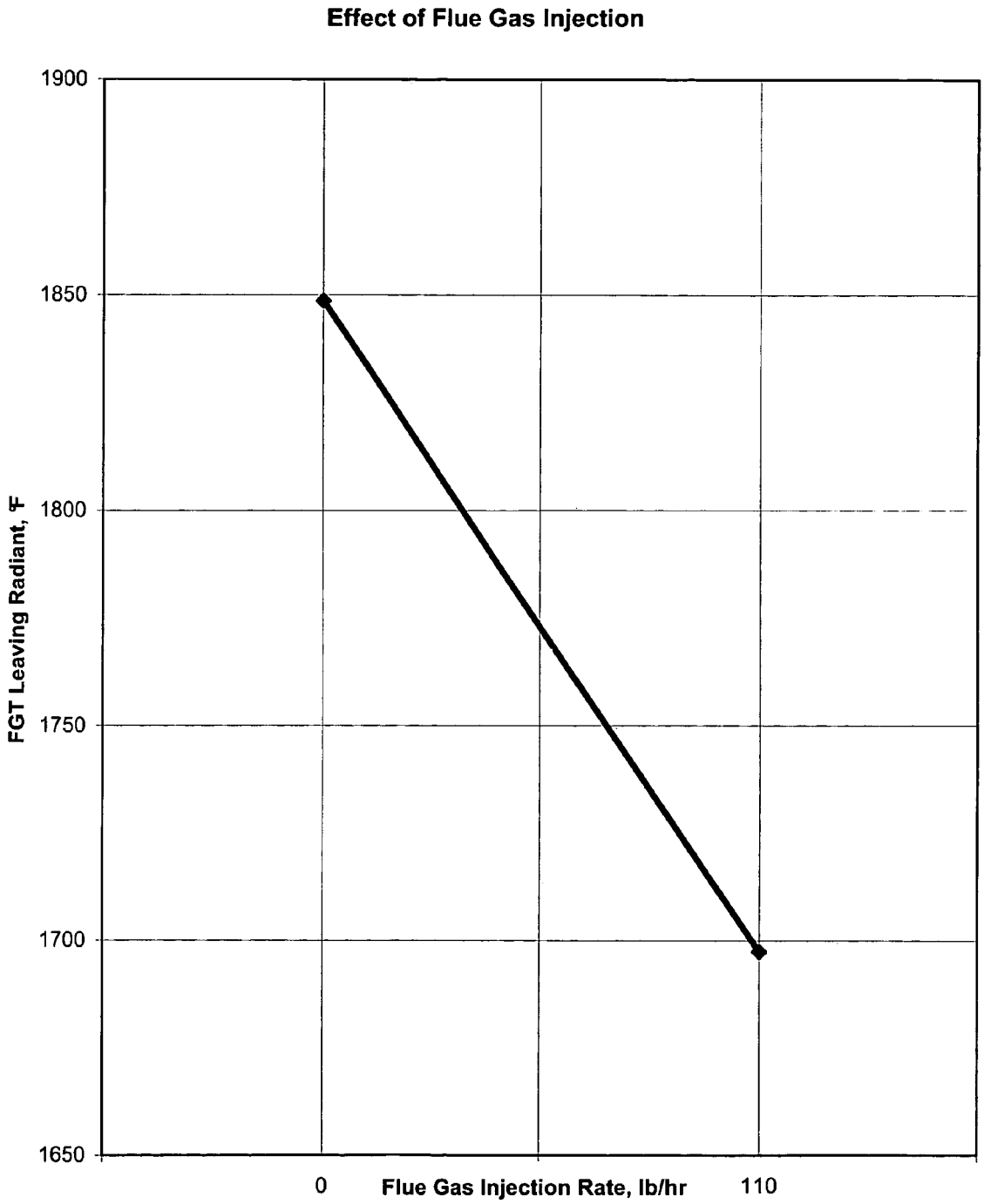
FIG. 3 graphically illustrates one aspect of the effects of one embodiment of my invention on heater operation.
Figure 4:
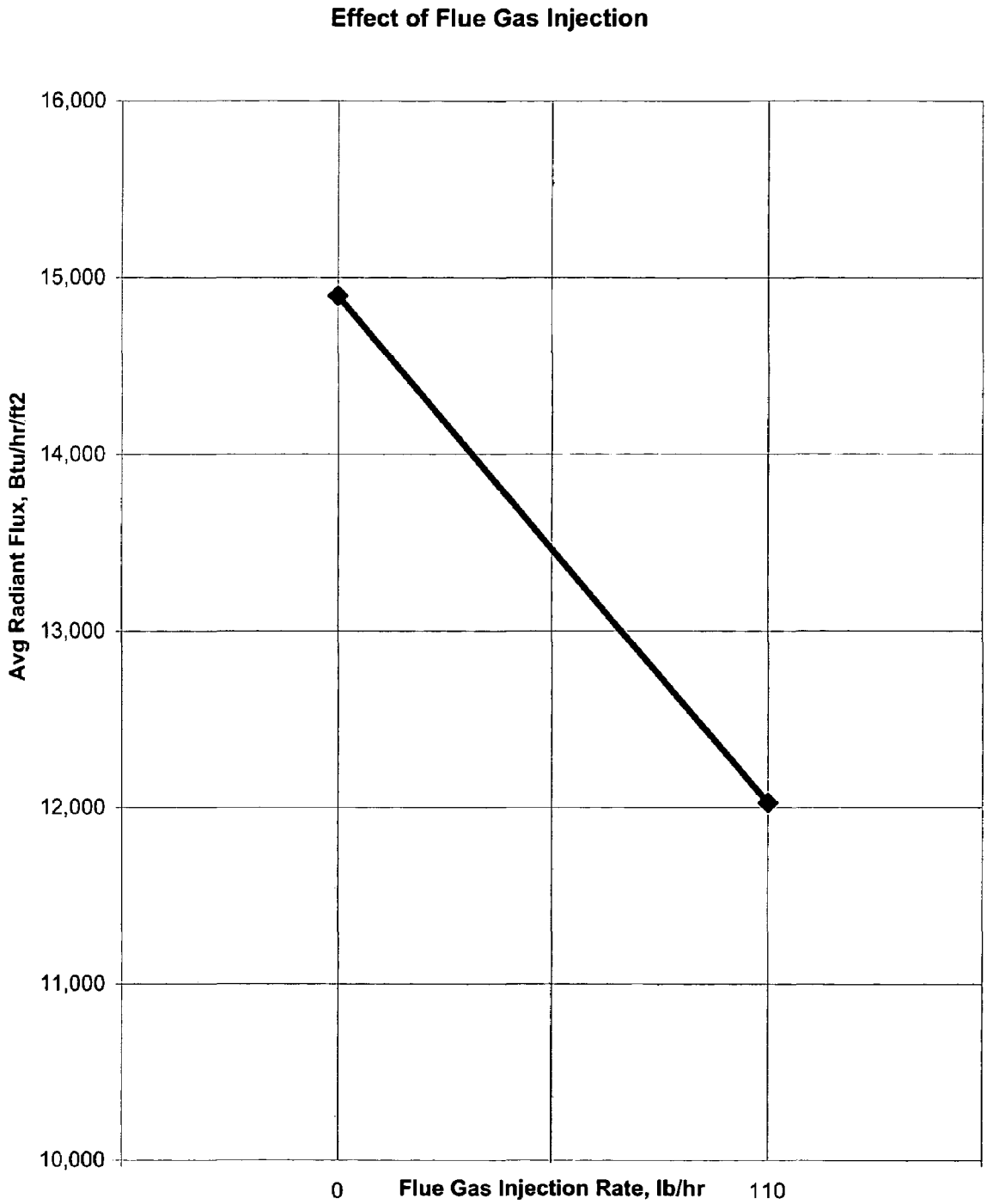
FIG. 4 graphically illustrates another aspect of the effects of one embodiment of my invention on heater operation.
Figure 5:
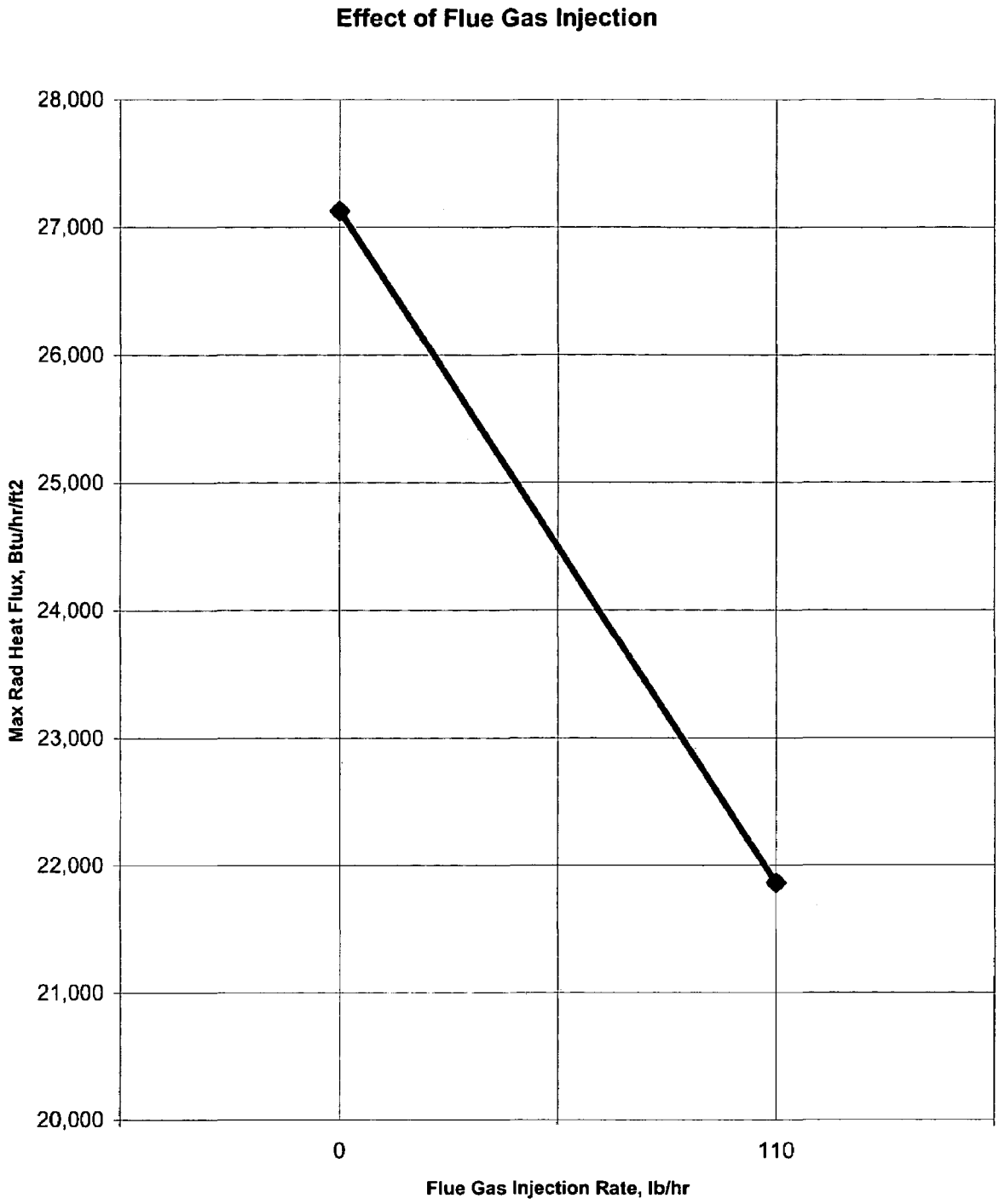
FIG. 5 graphically illustrates a further aspect of the effects of one embodiment of my invention on heater operation.
Figure 6:
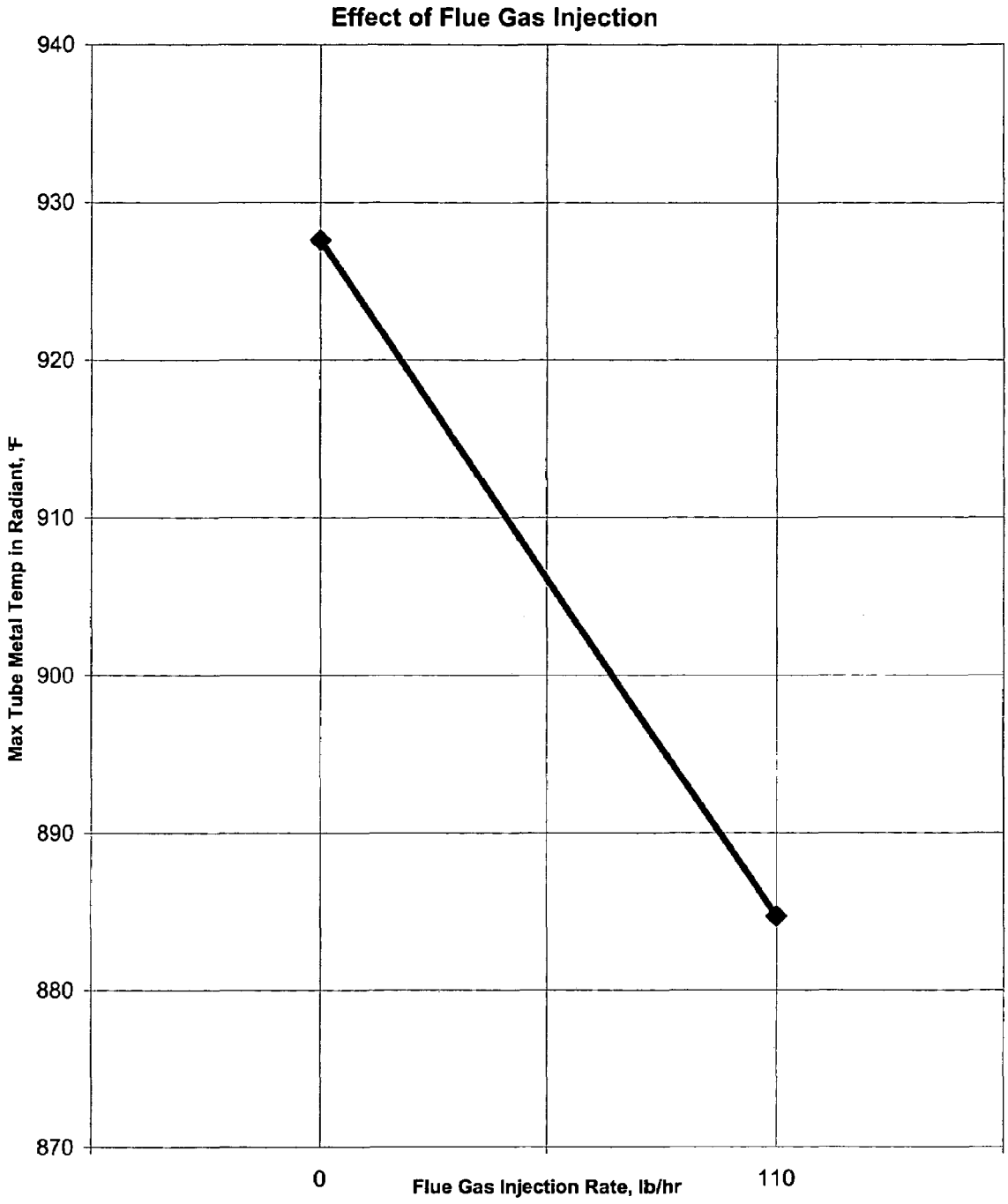
FIG. 6 graphically illustrates a further aspect of the effects of one embodiment of my invention on heater operation.
Figure 7:
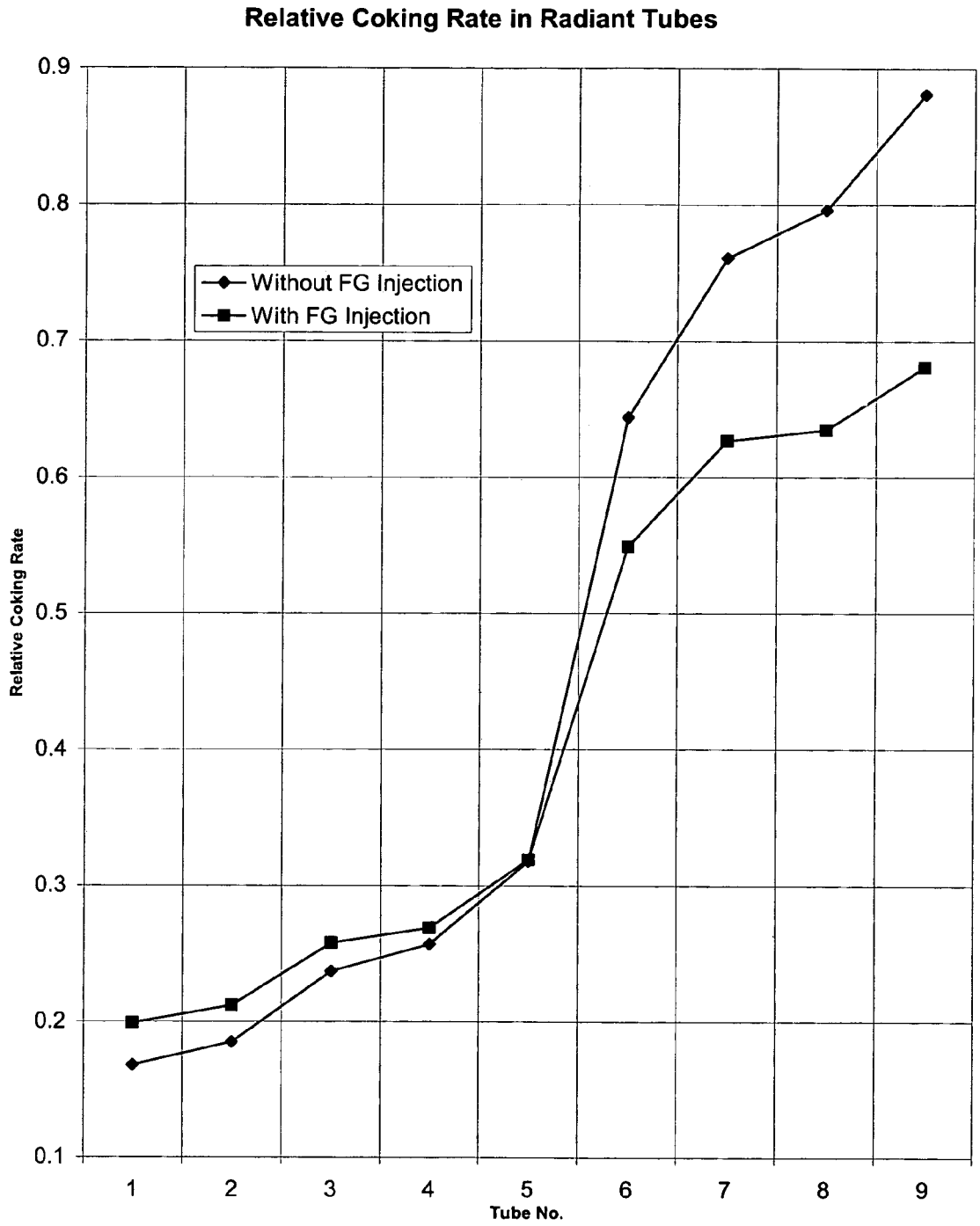
FIG. 7 graphically illustrates an additional aspect of the effects of one embodiment of my invention on heater operation.

[1]FIG. 3 shows the effect of increasing flue gas injection on the parameter shown
[2]FIG. 4 shows the effect of increasing flue gas injection on the parameter shown
[3]FIG. 5 shows the effect of increasing flue gas injection on the parameter shown
[4]FIG. 6 shows the effect of increasing flue gas injection on the parameter shown
[5]FIG. 7 shows the relative coking rates of the tubes, with and without FGI While certain preferred embodiments of the invention have been described herein, the invention is not to be construed as being so limited, except to the extent that such limitations are found in the claims.

What is claimed is:

1. Apparatus comprising a floor, wall means extending upwardly from the floor defining a peripherally enclosed radiant heating furnace section, at least one burner opening into the radiant heating furnace section through the floor, said at least one burner producing a flame and flue gases, a stack positioned in flow communication with the radiant heating furnace section to carry away the flue gases produced by the at least one burner, a set of radiant tubes positioned adjacent the wall means for receiving a hydrocarbon containing charge stock and heating said hydrocarbon-containing charge stock primarily by radiant heating, a supply of a hydrocarbon-containing charge stock connected in flow communication with the set of radiant tubes, a supply of combustible fuel and a supply of combustion-supporting gas connected in flow communication with the at least one burner, a manifold means defining a plurality of upwardly oriented openings peripherally spaced around the at least one burner at a location closely adjacent the set of radiant tubes for the introduction of gas along an inwardly facing surface of the set of radiant tubes, and a conduit means connecting the stack and the manifold means to carry flue gas from the stack to the manifold means to form a curtain of flue gas between each flame and the set of radiant tubes.

2. Apparatus as in claim 1 wherein the conduit means further comprising a blower to draw flue gases from the stack and inject flue gases into the radiant heating furnace section.

3. Apparatus as in claim 1 wherein the wall means further defines a peripherally enclosed convection heating furnace upper section in flow communication with the radiant heating furnace section, said convection section receiving flue gases from the radiant heating furnace section and exhausting flue gases to the stack, said apparatus further comprising a set of convection tubes positioned across the upper convection section for receiving a hydrocarbon-containing charge stock and heating said hydrocarbon-containing charge stock though primarily convection heating, said set of radiant tubes receiving the hydrocarbon containing charge stock from said set of convection tubes.

4. Apparatus as in claim 3 wherein said set of convection tubes has a first heat duty as measured in MMBtu/hr, said set of radiant tubes has a second heat duty as measured in MMBtu/hr, and the ratio between the first heat duty and the second heat duty is at least 35/65.

5. Apparatus as in claim 4 wherein the ratio between the first heat duty and the second heat duty is between 35/65 and 50/50.

6. Apparatus as in claim 1 wherein the manifold means and the conduit means are sized to inject in the range of 15% to 60% of the flue gases into the radiant heating furnace section.

7. Apparatus comprising a floor, wall means extending upwardly from the floor defining a peripherally enclosed radiant heating furnace section, at least one burner opening into the radiant heating furnace section through the floor, said at least one burner producing a flame and flue gases, a stack positioned in flow communication with the radiant heating furnace section to carry away the flue gases produced by the at least one burner, a set of radiant tubes positioned adjacent the wall means for receiving a hydrocarbon containing charge stock and heating said hydrocarbon-containing charge stock primarily by radiant heating, a supply of a hydrocarbon-containing charge stock connected in flow communication with the set of radiant tubes, a supply of combustible fuel and a supply of combustion-supporting gas connected in flow communication with the at least one burner, a manifold means defining a plurality of upwardly oriented openings peripherally spaced around the at least one burner at a location closely adjacent the set of radiant tubes for the introduction of gas along an inwardly facing surface of the set of radiant tubes, and a conduit means connecting the stack and the manifold means to carry flue gas from the stack to the manifold means to form a curtain of flue gas between each flame and the set of radiant tubes, wherein the peripherally enclosed radiant heating furnace section is generally cylindrically shaped and vertically oriented and the manifold means comprises a hollow plenum ring having discharge openings in flow communication with the plurality of upwardly oriented openings.

8. Apparatus as in claim 7 wherein the manifold means defines in the range of from 6 to 36 upwardly oriented openings laid out to produce a cylindrically shaped curtain of flue gases along an inwardly facing surface of the set of radiant tubes.

9. Apparatus as in claim 8 wherein the upwardly oriented openings are defined by nozzles.

10. A method of operating a fired heater to heat a hydrocarbon feedstock flowing though a tubing positioned along a periphery of said heater, said heater comprising one or more burners positioned at a spaced apart location inwardly from the tubing, said method comprising introducing a plurality of relatively cool gas streams between the burners and the tubing to moderate burner heat flux on the tubing, wherein the burners produce flue gases.. said process further comprising cooling the flue gases and forming the relatively cool gas streams from a portion of the cooled flue gases, wherein in the range of 15% to 60% of the flue gases produced by the at least one burner is used to form the relatively cool gas streams, and wherein the relatively cool gas streams are introduced into the fired heater from a curtain of relatively cool gases adjacent a side of the tubing facing the burners.

11. Apparatus comprising a floor, wall means extending upwardly from the floor defining a peripherally enclosed radiant heating furnace section, a stack positioned in flow communication with the radiant heating furnace section to carry away flue gases produced in the furnace section, a set of radiant tubes positioned adjacent to the wall means for receiving a hydrocarbon containing charge stock and heating said hydrocarbon-containing charge stock primarily by radiant heating, a supply of a hydrocarbon-containing charge stock connected in flow communication with the set of radiant tubes, a plurality of burners opening into the peripherally enclosed radiant heating furnace section from the floor at spaced apart locations from the set of radiant tubes, each of said plurality of burners being connected to a supply of combustible fuel and a supply of combustion-supporting gas and operable to produce a flame extending upwardly through the radiant section generally toward the stack, and flue gases, each of said plurality of burners being angled away from a most closely adjacent radiant tube of the set of radiant tubes so that the produced flame angles away from the most closely adjacent radiant tube of the set.

12. Apparatus as in claim 11 wherein the angle is in the range of from 5 degrees to 15 degrees, as measured from vertical.

13. Apparatus as in claim 12 wherein the wall means defines a generally cylindrical radiant heating furnace section.

14. Apparatus as in claim 13 wherein the wall means further defines a peripherally enclosed convection heating furnace upper section in flow communication with the radiant heating furnace section, said convection section receiving flue gases from the radiant heating furnace section and exhausting flue gases to the stack, said apparatus further comprising a set of convection tubes positioned across the upper convection section for receiving a hydrocarbon-containing charge stock and heating said hydrocarbon-containing charge stock though primarily convection heating, said set of radiant tubes receiving the hydrocarbon containing charge stock from said set of convection tubes, said set of convection tubes has a first heat duly as measured in MMBtu/br, said set of radiant tubes has a second heat duty as measured in MMIBtu/hr, and the ratio between the first heat duty and the second heat duty is at least 35/65.

* * * * *